US010869569B2

(12) United States Patent
Lehtonen

(10) Patent No.: US 10,869,569 B2
(45) Date of Patent: Dec. 22, 2020

(54) PURSE STORAGE HOOK WITH PROTECTIVE COVER

(71) Applicant: Donna L. E. Lehtonen, Naples, FL (US)

(72) Inventor: Donna L. E. Lehtonen, Naples, FL (US)

( * ) Notice: Subject to any disclaimer, the term of this patent is extended or adjusted under 35 U.S.C. 154(b) by 0 days.

(21) Appl. No.: 16/505,020

(22) Filed: Jul. 8, 2019

(65) Prior Publication Data

US 2020/0367684 A1 Nov. 26, 2020

Related U.S. Application Data

(63) Continuation-in-part of application No. 16/419,075, filed on May 22, 2019.

(51) Int. Cl.

| | |
|---|---|
| ***A47G 29/08*** | (2006.01) |
| ***A47F 1/14*** | (2006.01) |
| ***A44B 18/00*** | (2006.01) |
| ***A45C 3/00*** | (2006.01) |
| ***A45C 3/06*** | (2006.01) |
| ***A45C 13/00*** | (2006.01) |

(52) U.S. Cl.

CPC ..... *A47G 29/083* (2013.01); *A44B 18/00* (2013.01); *A45C 3/06* (2013.01); *A45C 13/002* (2013.01); *A45C 13/001* (2013.01); *A47G 29/08* (2013.01)

(58) Field of Classification Search

CPC ..... A47G 29/083; A44B 18/00; A45C 3/06; A45C 13/002; A45C 13/001; A45F 5/02; A45F 5/10; B62B 9/26

See application file for complete search history.

(56) References Cited

U.S. PATENT DOCUMENTS

| | | | | |
|---|---|---|---|---|
| 2,064,133 | A | 12/1936 | Von Schroeder | |
| 2,532,255 | A | 11/1950 | Davis | |
| 3,860,210 | A | 1/1975 | Berardinelli et al. | |
| 4,118,001 | A | 10/1978 | Serkez | |
| D300,882 | S | 5/1989 | Olson | |
| 5,664,712 | A * | 9/1997 | Smrt | A45F 5/02 224/250 |
| D429,899 | S | 8/2000 | Schwartz | |
| 7,644,900 | B2 | 1/2010 | Yap et al. | |
| D624,758 | S | 10/2010 | Seehoff | |
| 9,463,752 | B1 * | 10/2016 | Lehtonen | B60R 7/08 |
| 9,756,917 | B2 * | 9/2017 | Zech | A45C 13/001 |
| 9,930,985 | B2 | 4/2018 | Daring | |
| 2004/0206868 | A1 * | 10/2004 | Kaufman | B62B 9/26 248/214 |
| 2005/0161570 | A1 | 7/2005 | Bauerly | |
| 2008/0054139 | A1 | 3/2008 | Fabbri | |

(Continued)

*Primary Examiner* — Tan Le

(74) *Attorney, Agent, or Firm* — Livingston Loeffler, P.A.; Edward M. Livingston, Esq.; Bryan L. Loeffler, Esq.

(57) ABSTRACT

A purse storage hook (1) having a C-shaped body (2) that is placed over an edge of a table or counter. A bottom support strap (6) extends from a bottom horizontal arm (4) of the purse storage hook and may be wrapped around one or more purse handles (16) to act as a sling that supports the purse handles and distributes pressure along a predetermined length of the purse handles. A protective cover (22) protects a purse from spills while hanging from the purse storage hook or while being carried.

10 Claims, 8 Drawing Sheets

(56) References Cited

U.S. PATENT DOCUMENTS

| | | | | |
|---|---|---|---|---|
| 2014/0048187 | A1* | 2/2014 | Marquez-Bottome ... | A45C 3/08<br>150/103 |
| 2015/0021369 | A1* | 1/2015 | Lehtonen ..... | B60R 7/043<br>224/275 |

* cited by examiner

PURSE STORAGE HOOK WITH PROTECTIVE COVER

FIELD OF THE INVENTION

This invention relates to purses and hand bags, and more particularly, a purse storage hook used to hang a purse in a suspended position without causing damage to the purse.

BACKGROUND OF THE INVENTION

Purses and handbags have always been a convenient and preferred method for females to carry and transport personal items. Purses can range in style and in value. Often, females have a collection of purses each serving a different purpose or having a specific style to match an outfit or occasion. Many purses can be expensive and/or may be made of delicate material, thus, keeping them in pristine condition is very important not only for aesthetic purposes but for resale purposes also.

One way this is accomplished is by not setting a purse down on the floor or on a table top where the bottom of the purse can acquired dirt or come into contact with other substances. Table mounted purse hooks have been one past solution to this problem. However, conventional purse hooks pose at least two problems. The first problem being that the purse hangs perpendicular to the hook, thereby hanging parallel to the edge of the table surface taking up space and leg room under the table. The second problem is that conventional purse hooks have a thin dowel-shaped or rectangular-shaped lower portion of the hook that makes contact with the handles of the purse. The thin profile of the hook causes the purse handles to fold over the hook, which can cause the handles to break and/or stretch, thereby becoming deformed.

An additional problem is protecting a purse after it has been stored on a hook. The positioning below the edge of a table exposes the purse to spills and food falling from the table and onto and/or into the purse.

Therefore, a need exists for a purse storage hook that provides proper support to purse handles and orients the purse in a direction that takes as little space as possible while being stored and a protective cover.

SUMMARY OF THE INVENTION

The primary object of the present invention is to provide a purse storage hook that provides proper support to purse handles and orients the purse in a direction that takes as little space as possible while being stored.

An additional object of the present invention is to provide a protective cover that protects a purse from spills while hanging from the purse storage hook.

An additional object of the present invention is to provide a protective cover that allows the purse to be carried while remaining fully covered.

An additional object of the present invention is to provide a purse storage hook that is capable of being attached to vertical surfaces.

The present invention fulfills the above and other objects by providing a purse storage hook having a C-shaped body that is placed over an edge of a table or counter. A bottom support strap extends from a bottom horizontal arm of the purse storage hook and may be wrapped around the handles of a purse. Then, the bottom support strap may be secured using a hook and loop fastener to create a sling that supports the purse handles and distributes pressure along a predetermined length of the purse handles. The bottom support strap prevents indentations from occurring in purse handles, which would occur if hanging the handles directly on the bottom horizontal arm of the purse storage hook. The bottom support strap may also extend from a hanger body that allows the purse to be stored on a closet bar, door knob, hook, retail display and so forth.

A top attachment strap preferably extends from a top horizontal arm of the purse storage hook. The top attachment strap has at least one magnet that allows a user to hang the purse storage hook from a metal surface, such as a bathroom stall.

A protective cover protects a purse from spills while hanging from the purse storage hook. and allows the purse to be carried while remaining fully covered.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
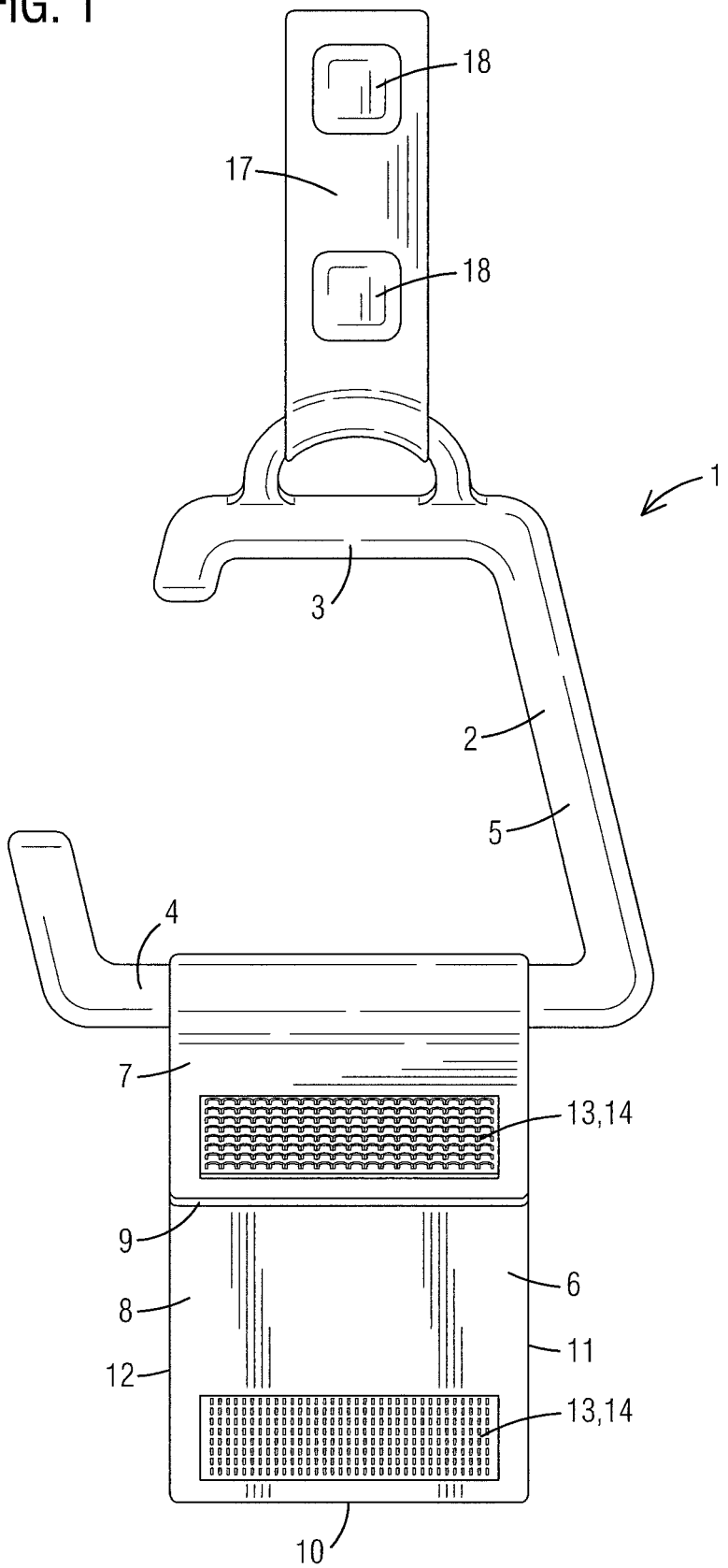
FIG. 1 is a front view of a purse storage hook of the present invention.
Figure 2:
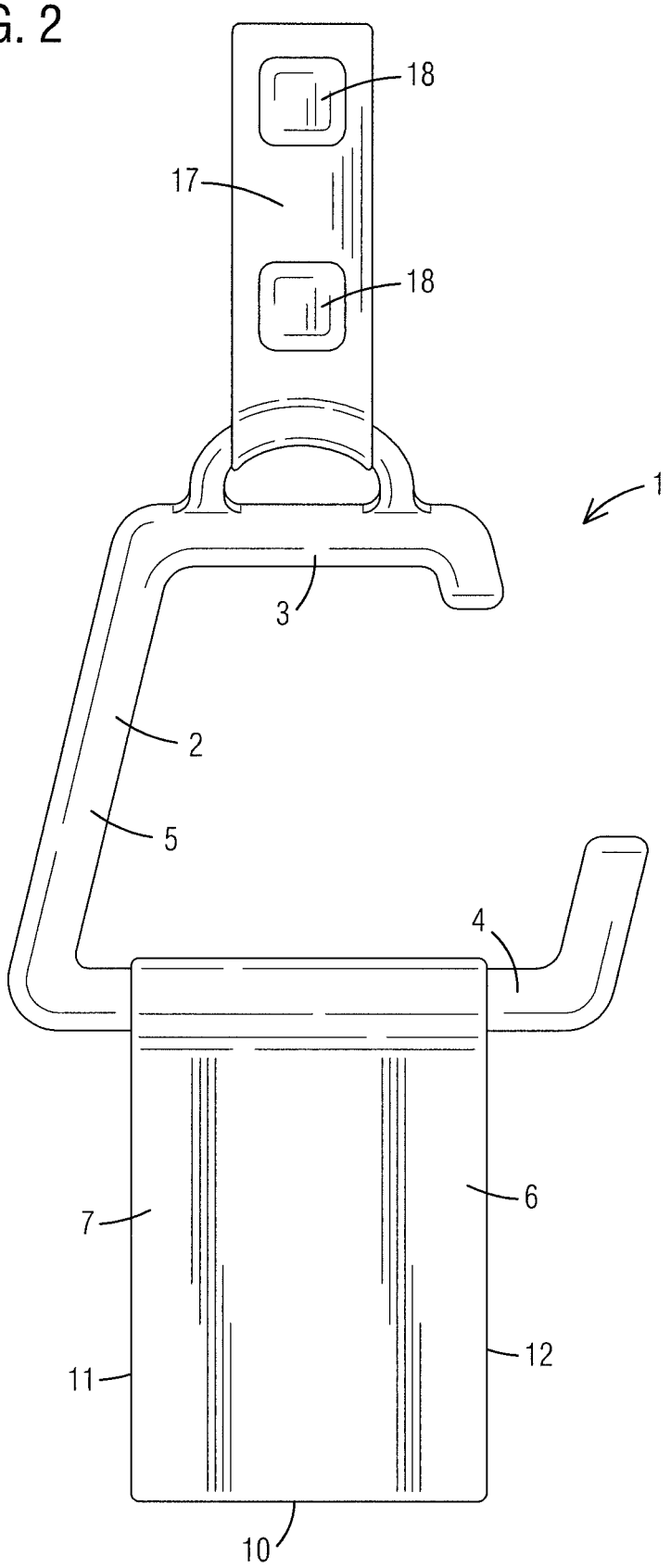
FIG. 2 is a back view of a purse storage hook of the present invention.
Figure 3:
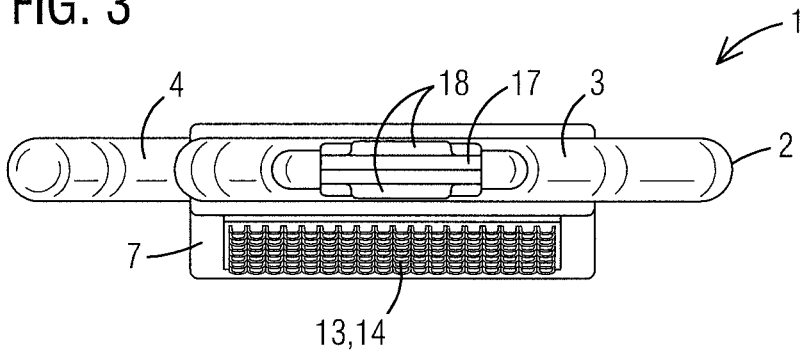
FIG. 3 is a top view of a purse storage hook of the present invention.
Figure 4:
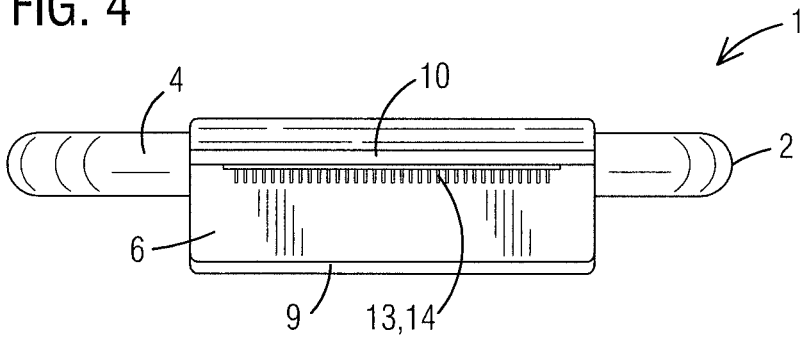
FIG. 4. is a bottom view of a purse storage hook of the present invention.
Figure 5:
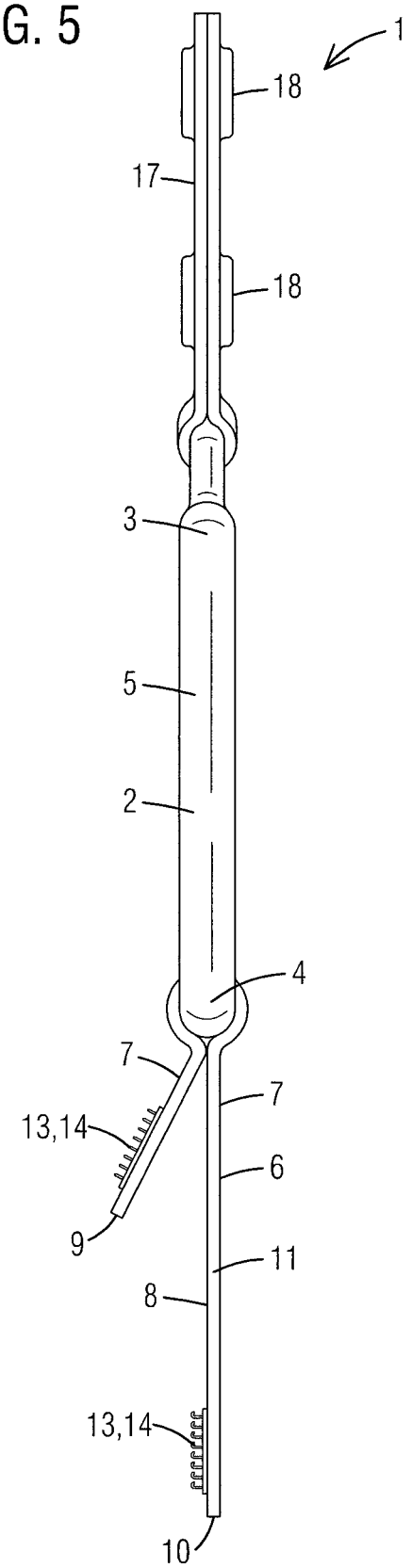
FIG. 5 is a right side view of a purse storage hook of the present invention.
Figure 6:
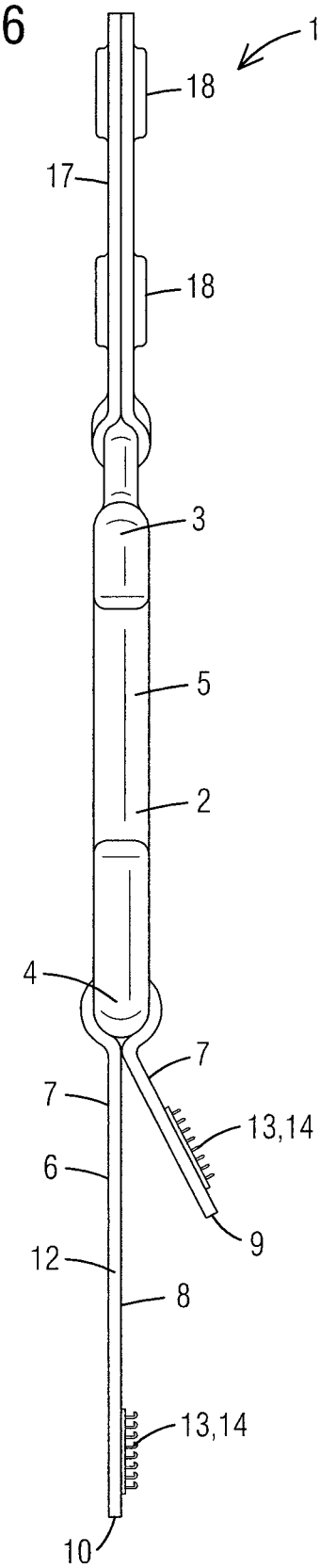
FIG. 6 is a left side view of a purse storage hook of the present invention.

For purposes of describing the preferred embodiment, the terminology used in reference to the numbered components in the drawings is as follows:

1. purse storage hook, generally
2. C-shaped body
3. top horizontal arm
4. bottom horizontal arm
5. vertical arm
6. bottom support strap
7. outer surface of bottom support strap
8. inner surface of bottom support strap
9. top edge of bottom support strap
10. bottom edge of bottom support strap

11. right side edge of bottom support strap
12. left side edge of bottom support strap
13. support strap attachment means
14. hook and loop fastener
15. purse
16. purse handle
17. top attachment strap
18. magnet
19. rigid hangar body
20. opening
21. attachment hook
22. purse cover
23. upper surface of purse cover
24. lower surface of purse cover
25. perimeter edge of purse cover
26. purse cover attachment means
27. aperture
28. closure means With reference to FIGS. 1-6, a purse storage hook 1 of the present invention is illustrated. The purse storage hook 1 comprises a substantially C-shaped body 2 made of a rigid material and having a top horizontal arm 3 and a bottom horizontal arm 4 connected by a vertical arm 5. A substantially rectangular-shaped bottom support strap 6 extends from the bottom horizontal arm 4. The substantially rectangular-shaped bottom support strap 6 comprises an outer surface 7, inner surface 8, top edge 9, bottom edge 10, right side edge 11 and left side edge 12. The substantially rectangular-shaped bottom support strap 6 is preferably attached to the bottom horizontal arm 4 by folding the bottom support strap 6 over the bottom horizontal arm 4 so that the inner surface 8 of the support strap 6 is in contact with the bottom horizontal arm 4 and the bottom edge 10 of the support strap 6 extends below the top edge 9 of the support strap 6. A seam 12 is preferably located on the bottom support strap 6 directly adjacent to the bottom horizontal arm 4 to cause the support strap 6 to encircle the bottom horizontal arm 4 and maintain the bottom edge 10 of the support strap 6 in a position below the top edge 9 of the support strap 6.

At least one support strap attachment means 13, such as a hook and loop fastener 14, snaps, adhesive, buttons, sewing and so forth, is preferably located adjacent to the bottom edge 10 and/or adjacent to the top edge 9 of the support strap 6. As illustrated herein, hook and loop faster 14 is located on the inner surface 8 of the support strap 6 adjacent to the bottom edge 10 of the support strap 6. A corresponding hook and loop faster 14 is located on the outer surface surface 7 of the support strap 6 adjacent to the top edge 9 of the support strap 6.

Figure 7:
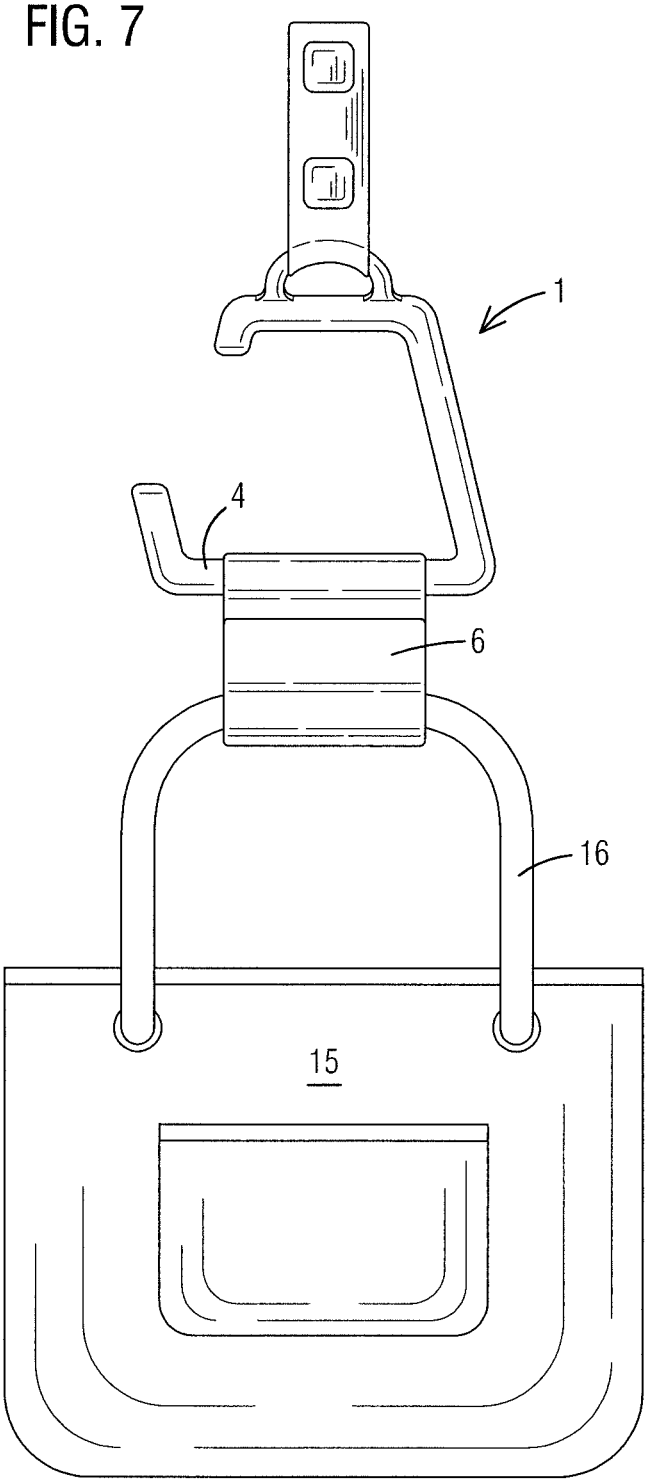
FIG. 7 is a left view of a purse storage hook of the present invention attached to a purse.

With reference to FIG. 7, a front view of a purse storage hook 1 of the present invention attached to a purse 15 is illustrated. The support strap 6 may be secured around one or more purse handles 16 and secured using an the hook and loop fastener 14 to create a sling that supports the purse handles 16 and distributes pressure along a predetermined length of the purse handles 16. The support strap 6 prevents indentations from occurring in purse handles 16. Alternatively, in instances when the support strap 6 may be inconvenient to use, a user may still hang purse handles 16 over the bottom horizontal arm 4 with the support strap 6 providing cushioning to the purse handles 16.

With reference to FIGS. 1-6, a top attachment strap 17 extends from the top horizontal arm 3 of the purse storage hook 1. The top attachment strap 17 has at least one magnet 18 located thereon that allows a user to hang the purse storage hook 1 from a metal surface, such as on a bathroom stall wall. As illustrated herein, the top attachment strap 17 has two magnets 18 space apart to allow the top attachment strap 17 to be folded over an object onto itself so the two magnets 18 engage each other, thereby locking the top attachment strap 17 onto the object.

Figure 8:
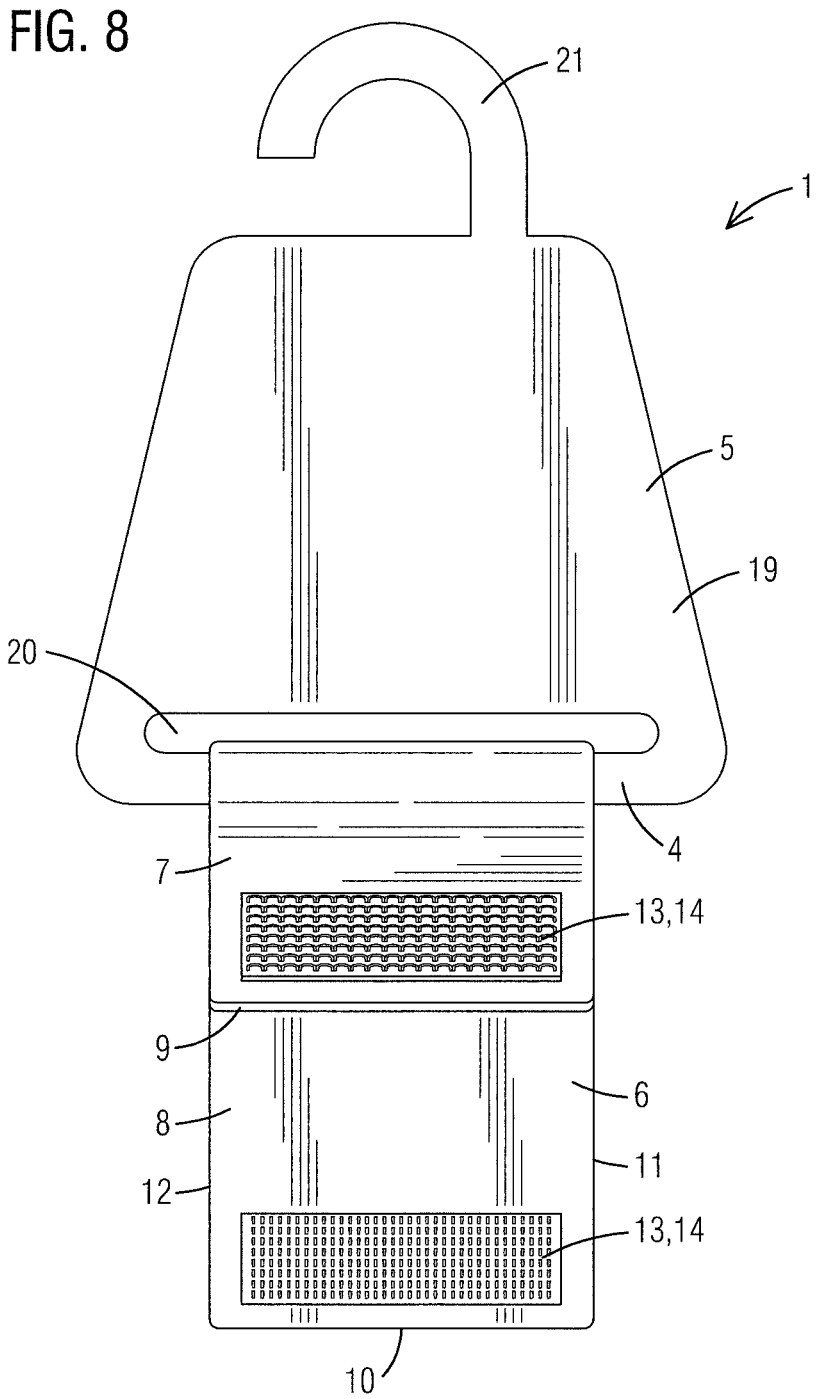
FIG. 8 is a front view of a purse storage hook of the present invention wherein the bottom support strap extends from a rigid hanger body.

With reference to FIG. 8, a front view of a purse storage hook 1 of the present invention wherein the bottom support strap 6 extends from a rigid or semi-rigid hanger body 19 is illustrated. The rigid hangar body 19 comprises at least two vertical side arms 5 and a bottom horizontal arm 4 forming an opening 20 through the rigid hangar body 19 to allow a bottom support strap 6 to be attached to the bottom horizontal arm 4.

The substantially rectangular-shaped bottom support strap 6 comprises an outer surface 7, inner surface 8, top edge 9, bottom edge 10, right side edge 11 and left side edge 12. The substantially rectangular-shaped bottom support strap 6 is preferably attached to the bottom horizontal arm 4 by folding the bottom support strap 6 over the bottom horizontal arm 4 so that the inner surface 8 of the support strap 6 is in contact with the bottom horizontal arm 4 and the bottom edge 10 of the support strap 6 extends below the top edge 9 of the support strap 6. A seam 12 is preferably located on the bottom support strap 6 directly adjacent to the bottom horizontal arm 4 to cause the support strap 6 to encircle the bottom horizontal arm 4 and maintain the bottom edge 10 of the support strap 6 in a position below the top edge 9 of the support strap 6.

At least one support strap support strap attachment means 13, such as a hook and loop fastener 14, snaps, adhesive, buttons, sewing and so forth, is preferably located adjacent to the bottom edge 10 and/or adjacent to the top edge 9 of the support strap 6. As illustrated herein, hook and loop faster 14 is located on the inner surface 8 of the support strap 6 adjacent to the bottom edge 10 of the support strap 6. A corresponding hook and loop faster 14 is located on the outer surface 7 of the support strap 6 adjacent to the top edge 9 of the support strap 6.

An attachment hook 21 extends upward from the rigid hanger body 19 to allow the purse storage hook 1 to be stored on a closet bar, door knob, hook, retail display and so forth. The attachment hook 21 may be open or closed to create a loop-shape.

Figure 9:
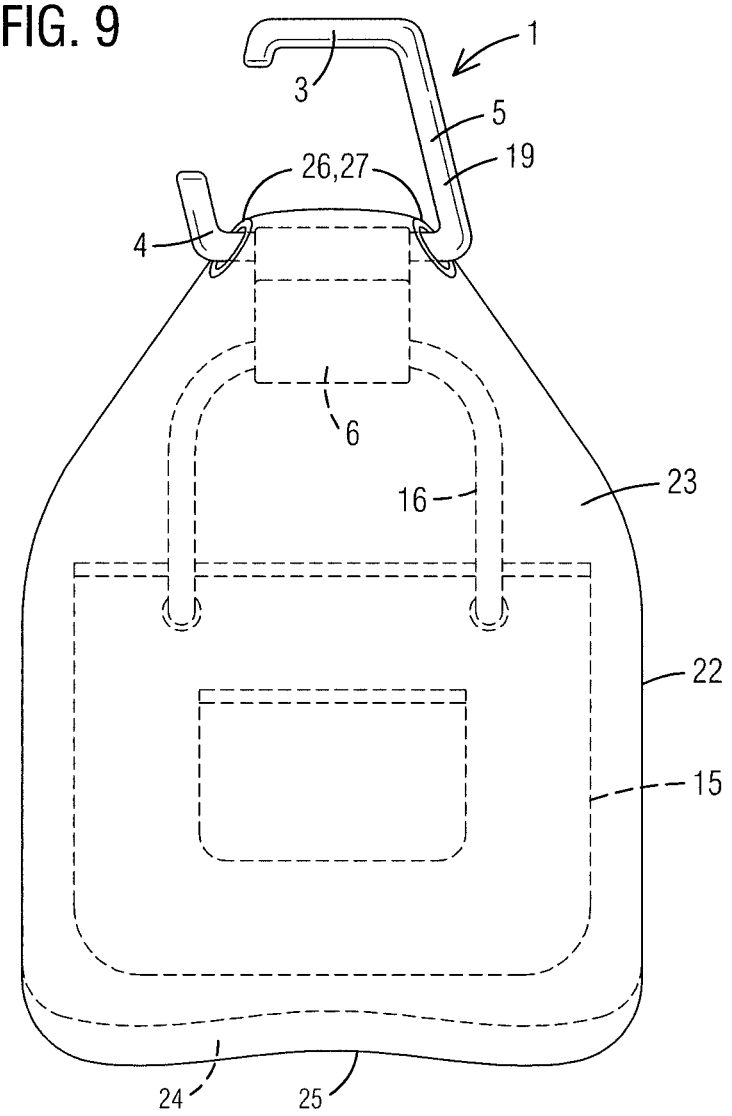
FIG. 9 is a front plan view of a purse storage hook of the present invention having an attachable protective cover located thereon.
Figure 10:
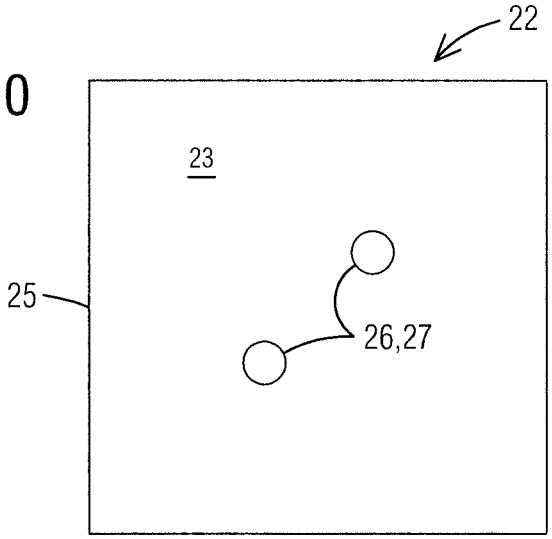
FIG. 10 is a top view of an attachable protective cover of the present invention covering a purse.

With reference to FIGS. 9 and 10, a front plan view of a purse storage hook 1 of the present invention having an attachable protective cover 22 and a top view of the attachable protective cover 22, respectively, is illustrated. The purse storage hook 1 comprises a substantially C-shaped body 2 made of a rigid material and having a top horizontal arm 3 and a bottom horizontal arm 4 connected by a vertical arm 5. A substantially rectangular-shaped bottom support strap 6 extends from the bottom horizontal arm 4.

The support strap 6 may be secured around one or more purse handles 16 of a purse 15 and secured using an the hook and loop fastener 14 to create a sling that supports the purse handles 16 and distributes pressure along a predetermined length of the purse handles 16. The support strap 6 prevents indentations from occurring in purse handles 16. Alternatively, in instances when the support strap 6 may be inconvenient to use, a user may still hang purse handles 16 over the bottom horizontal arm 4 with the support strap 6 providing cushioning to the purse handles 16. The purse cover 22 comprises an upper surface 23, lower surface 24 and a perimeter edge 25. The purse cover 22 is attachable to the C-shaped body 2 and/or the support strap 6 via at least one purse cover attachment means 26, such as apertures 27, grommets, apertures, snaps, hook and loop fastener. Alternatively, the purse cover 22 max be fixedly attached to the C-shaped body 2 and/or the support strap 6. As illustrated herein, the purse cover 22 has apertures 27 located centrally thereon that are placed over the bottom horizontal arm 4 so the purse cover 22 covers the entire purse and the purse handles 16.

Figure 11:
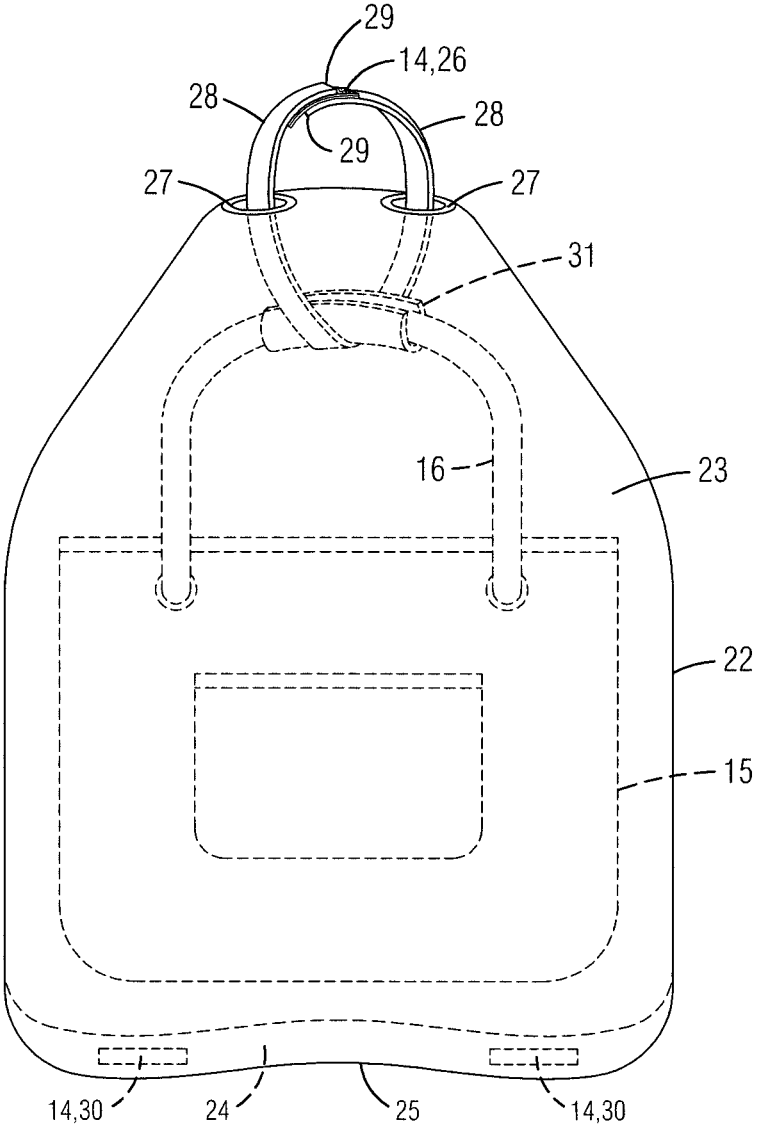
FIG. 11 is a plan side view of a purse cover of the present invention in use with a carrying strap.

With reference to FIG. 11, a plan side view of a purse cover 22 of the present invention in use with a carrying strap 28 is illustrated. The purse cover 22 comprises an upper surface 23, lower surface 24 and a perimeter edge 25. Two apertures 27 are located centrally on the purse cover 22. A carrying strap 28 having opposing ends 29 that attach via an attachment means 26, such as a hook and loop fastener 14, snaps, buttons and so forth, forms a loop that encircles purse handles 16 of a purse 15 and extends through said apertures 27 to allow a user to carry the purse 15 while being the purse cover 22 drapes over the entire purse and the purse handles 16. At least one closure means 30, such as a hook and loop fastener 14, snaps, buttons and so forth, is preferably located on the lower surface 24 of the purse cover 22 adjacent to the perimeter edge 25 thereof to allow the purse cover 22 to be closed around the purse 15. A purse handle support 31 may be located on the carrying strap 28 in a position perpendicular to the carrying strap 28 to provide a sling that supports the purse handles 16 and distributes pressure along a predetermined length of the purse handles 16. The purse handle support 31 may unfold to provide a carrying case for the purse cover 22 when not in use.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A purse storage hook comprising:

a substantially C-shaped body constructed of a rigid material and having a top horizontal arm and a bottom horizontal arm connected by a vertical arm;

a substantially rectangular-shaped bottom support strap extending downward from the bottom horizontal arm;

said bottom support strap having an outer surface, inner surface, top edge, bottom edge, right side edge and left side edge;

at least one support strap attachment means located on the bottom support strap for securing the bottom support strap around at least one purse handle;

a purse cover having an upper surface, a lower surface and a perimeter edge; and said purse cover extending downward from the C-shaped body.

2. The purse storage hook of claim 1 wherein:

said purse cover attaches to said C-shaped body via at least one attachment means.

3. The purse storage hook of claim 1 wherein:

said purse cover attaches to said C-shaped body via at least one aperture located centrally on said purse cover.

4. The purse storage hook of claim 1 wherein:

said bottom support strap is attached to the bottom horizontal arm by folding the bottom support strap over the bottom horizontal arm so that the inner surface of the support strap is in contact with the bottom horizontal arm.

5. The purse storage hook of claim 4 wherein:

said bottom edge of the bottom support strap extends below the top edge of the support strap.

6. The purse storage hook of claim 5 further comprising:

a seam located on the bottom support strap directly adjacent to the bottom horizontal arm to cause the bottom support strap to encircle the bottom horizontal arm and maintain the bottom edge of the support strap in a position below the top edge of the support strap.

7. The purse storage hook of claim 1 wherein:

said at least one support strap attachment means is a hook and loop fastener.

8. The purse storage hook of claim 7 wherein:

said hook and loop faster is located on the inner surface of the support strap adjacent to the bottom edge of the support strap.

9. The purse storage hook of claim 8 further comprising:

a corresponding hook and loop faster located on the outer surface of the support strap adjacent to the top edge of the support strap.

10. A purse cover comprising:

an upper surface, lower surface and a perimeter edge;

at least two apertures located centrally on said purse cover;

a carrying strap having opposing ends that attach via an attachment means;

said carrying strap capable of encircling at least one purse handle of a purse and extending through said at least two apertures to provide means for carrying said purse while being the purse cover drapes over the entire purse and said at least one purse handle;

at least one closure means located on the lower surface of the purse cover adjacent to the perimeter edge;

at least one hook and loop fastener located on the lower surface of the purse cover adjacent to the perimeter edge;

a purse handle support located on said carrying strap in a position perpendicular to the carrying strap to provide a sling that supports the at least one purse handle and distributes pressure along a predetermined length of the at least one purse handle;

a substantially C-shaped body constructed of a rigid material and having a top horizontal arm and a bottom horizontal arm connected by a vertical arm;

a substantially rectangular-shaped bottom support strap extending downward from the bottom horizontal arm;

said bottom support strap having an outer surface, inner surface, top edge, bottom edge, right side edge and left side edge;

at least one support strap attachment means located on the bottom support strap for securing the bottom support strap around at least one purse handle; and said purse cover being attachable to said C-shaped body via said at least one aperture located centrally on said purse cover.

* * * * *